US008998670B1

(12) United States Patent
De Leon

(10) Patent No.: US 8,998,670 B1
(45) Date of Patent: Apr. 7, 2015

(54) FIGURINE SYSTEM

(71) Applicant: Efrain De Leon, Hesperia, CA (US)

(72) Inventor: Efrain De Leon, Hesperia, CA (US)

( * ) Notice: Subject to any disclaimer, the term of this patent is extended or adjusted under 35 U.S.C. 154(b) by 0 days.

(21) Appl. No.: 13/949,614

(22) Filed: Jul. 24, 2013

(51) Int. Cl.
*A63H 3/16* (2006.01)
*A63H 7/00* (2006.01)

(52) U.S. Cl.
CPC ..... *A63H 7/00* (2013.01)

(58) Field of Classification Search
CPC ..... A63H 3/12; A63H 3/16; A63H 3/46; A63H 3/48; A63H 3/365; G09B 23/36
USPC ..... 446/97, 99, 100, 101, 321, 337, 339, 446/390; 434/295, 296
See application file for complete search history.

(56) References Cited

U.S. PATENT DOCUMENTS 858,090 A * 6/1907 Meinecke ..... 446/99
1,322,713 A 11/1919 Marshall
4,208,832 A 6/1980 Corriveau
4,869,701 A * 9/1989 Kawai et al. ..... 446/91
5,378,184 A * 1/1995 Bro et al. ..... 446/99
5,788,554 A * 8/1998 Goodwin et al. ..... 446/100
5,897,420 A 4/1999 Lawrence et al.
5,913,706 A * 6/1999 Glickman et al. ..... 446/97
5,980,260 A * 11/1999 Caputi ..... 434/295
D419,915 S 2/2000 Cohen
6,887,120 B2 5/2005 Shamitoff
D536,044 S 1/2007 Ban
D576,217 S 9/2008 Pasko
7,520,793 B2 * 4/2009 Pillai et al. ..... 446/97

* cited by examiner

*Primary Examiner* — Kurt Fernstrom

(57) ABSTRACT

A figurine system having interchangeable appendages features a body component having a general shape of a body of an animal. A body anterior end features a female head component slot. A body posterior end features a female tail component slot. A body first side features a female first anterior limb component slot and a female first posterior limb component slot. A body second side features a second female anterior limb component slot and a female second posterior limb component slot. The system features a head component, a tail component, a first anterior limb component, a first posterior limb component, a second anterior limb component, and a second posterior limb component. The system features a plurality of adapter components.

4 Claims, 4 Drawing Sheets

FIGURINE SYSTEM

FIELD OF THE INVENTION

The present invention relates to figurines, or more specifically, figurines with removable and replaceable appendages.

BACKGROUND OF THE INVENTION

Toys resembling animals have been around for many years. Many of these toys feature movable parts or removable and replaceable parts to stimulate the learning experience for the child. The present invention features a figurine system featuring different types of animals having interchangeable appendages.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a figurine system having interchangeable appendages. In some embodiments, the system comprises a body component. In some embodiments, the body component comprises a general shape of a body of an animal having a neck area, a tail area, an anterior leg first side area, a posterior leg first side area, an anterior leg second side area, a posterior leg second side area, and a tail area corresponding to the respective locations on the body of the animal.

In some embodiments, a body anterior end comprises a female head component slot having a shape of a triangular prism located therein. In some embodiments, a body posterior end comprises a female tail component slot having a shape of a first cylindrical channel located therein.

In some embodiments, a body first side comprises a female first anterior limb component slot having a shape of a rectangular prism located therein and a female first posterior limb component slot having a shape of a second cylindrical channel located therein. In some embodiments, a the body second side comprises a second female anterior limb component slot having a shape of the rectangular prism located therein and a female second posterior limb component slot having a shape of the second cylindrical channel located therein.

In some embodiments, the system comprises a head component having a general shape of a head of the animal. In some embodiments, a head component posterior end comprises a male head component projection having a shape of the triangular prism located thereon. In some embodiments, the male head component projection is designed to snuggly insert into the female head component slot.

In some embodiments, the system comprises a tail component having a general shape of a tail of the animal. In some embodiments, a tail component anterior end comprises a male tail component projection having a shape of a first cylinder located thereon. In some embodiments, the male tail component projection is designed to snuggly insert into the female tail component slot.

In some embodiments, the system comprises a first anterior limb component having a general shape of front limb of the animal. In some embodiments, the first anterior limb component anterior end comprises a male first anterior limb component projection having a shape of the rectangular prism located thereon. In some embodiments, the male first anterior limb component projection is designed to snuggly insert into the female first anterior limb component slot.

In some embodiments, the system comprises a first posterior limb component having a general shape of rear limb of the animal. In some embodiments, the first posterior limb component anterior end comprises a male first posterior limb component projection having a shape of a second cylinder located thereon. In some embodiments, the male first posterior limb component projection is designed to snuggly insert into the female first posterior limb component slot.

In some embodiments, the system comprises a second anterior limb component having a general shape of front limb of the animal. In some embodiments, the second anterior limb component anterior end comprises a male second anterior limb component projection having the shape of the rectangular prism located thereon. In some embodiments, the male second anterior limb component projection is designed to snuggly insert into the female second anterior limb component slot.

In some embodiments, the system comprises a second posterior limb component having a general shape of rear limb of the animal. In some embodiments, the second posterior limb component anterior end comprises a male second posterior limb component projection having a shape of a second cylinder located thereon. In some embodiments, the male second posterior limb component projection is designed to snuggly insert into the female second posterior limb component slot.

In some embodiments, the system comprises a plurality of adapter components. In some embodiments, the adapter comprises an offset length from the adapter anterior end to the posterior end.

DESCRIPTION OF PREFERRED EMBODIMENTS

Figure 1:
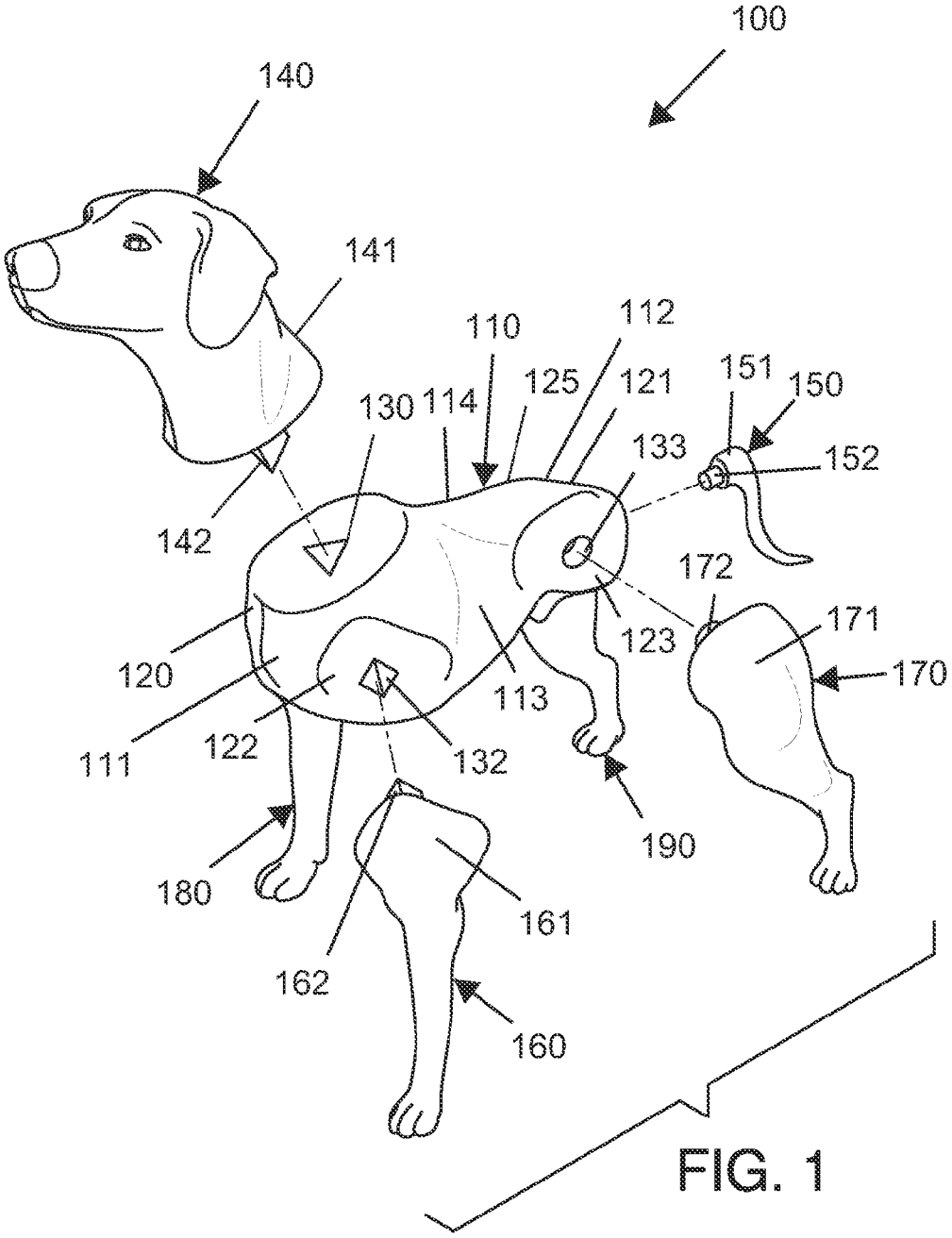
FIG. 1 shows a perspective view of the present invention in unassembled form.

Following is a list of elements corresponding to a particular element referred to herein:

100 Figurine system
110 Body component
111 Body anterior end
112 Body posterior end
113 Body first side
114 Body second side
120 Neck area
121 Tail area
122 Anterior leg first side area
123 Posterior leg first side area
124 Anterior leg second side area
125 Posterior leg second side area

Figure 2:
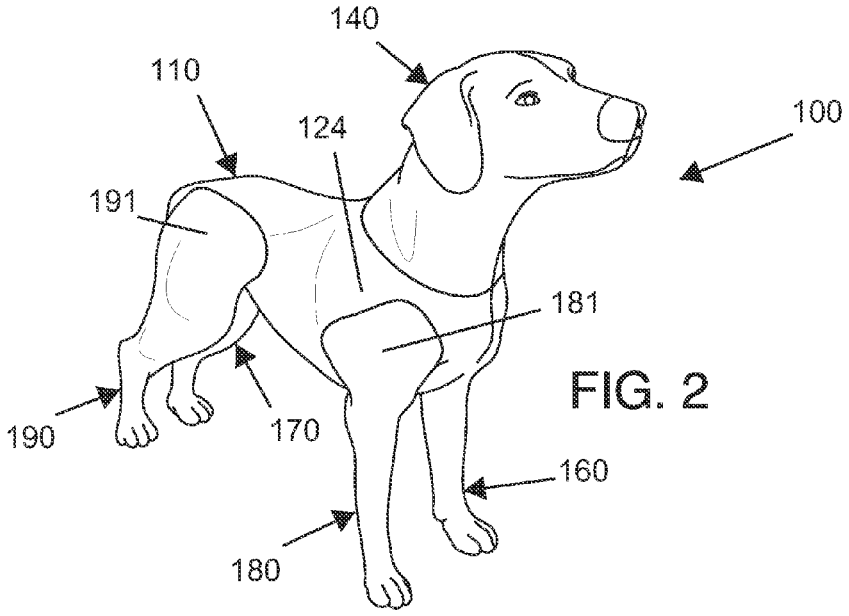
FIG. 2 shows a perspective view of the present invention in assembled form.
Figure 3:
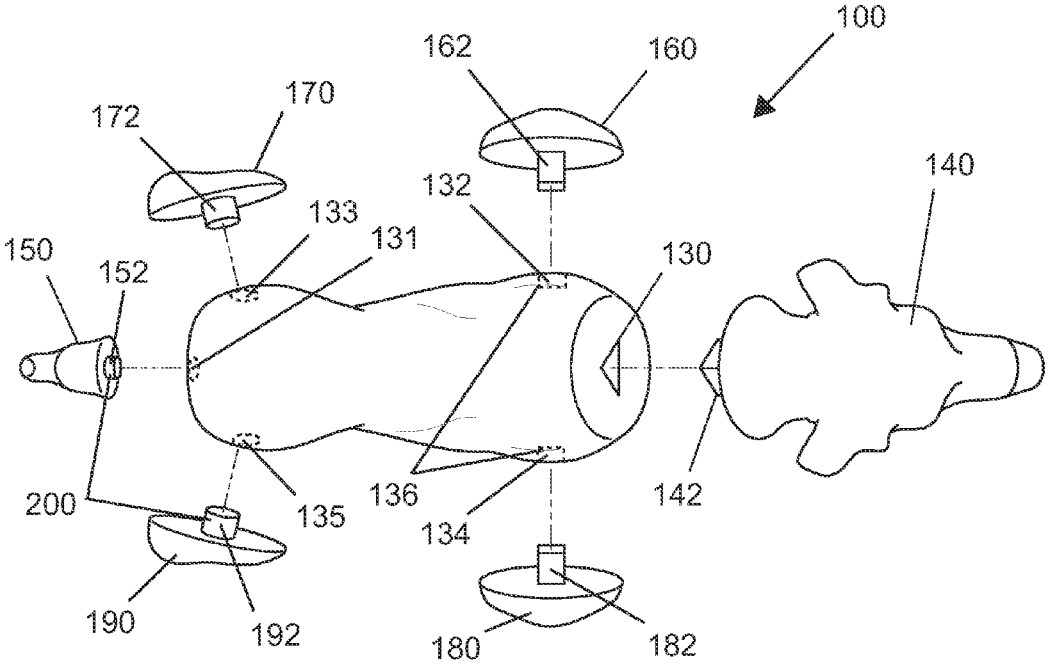
FIG. 3 shows a top view of the present invention in unassembled form.
Figure 4:
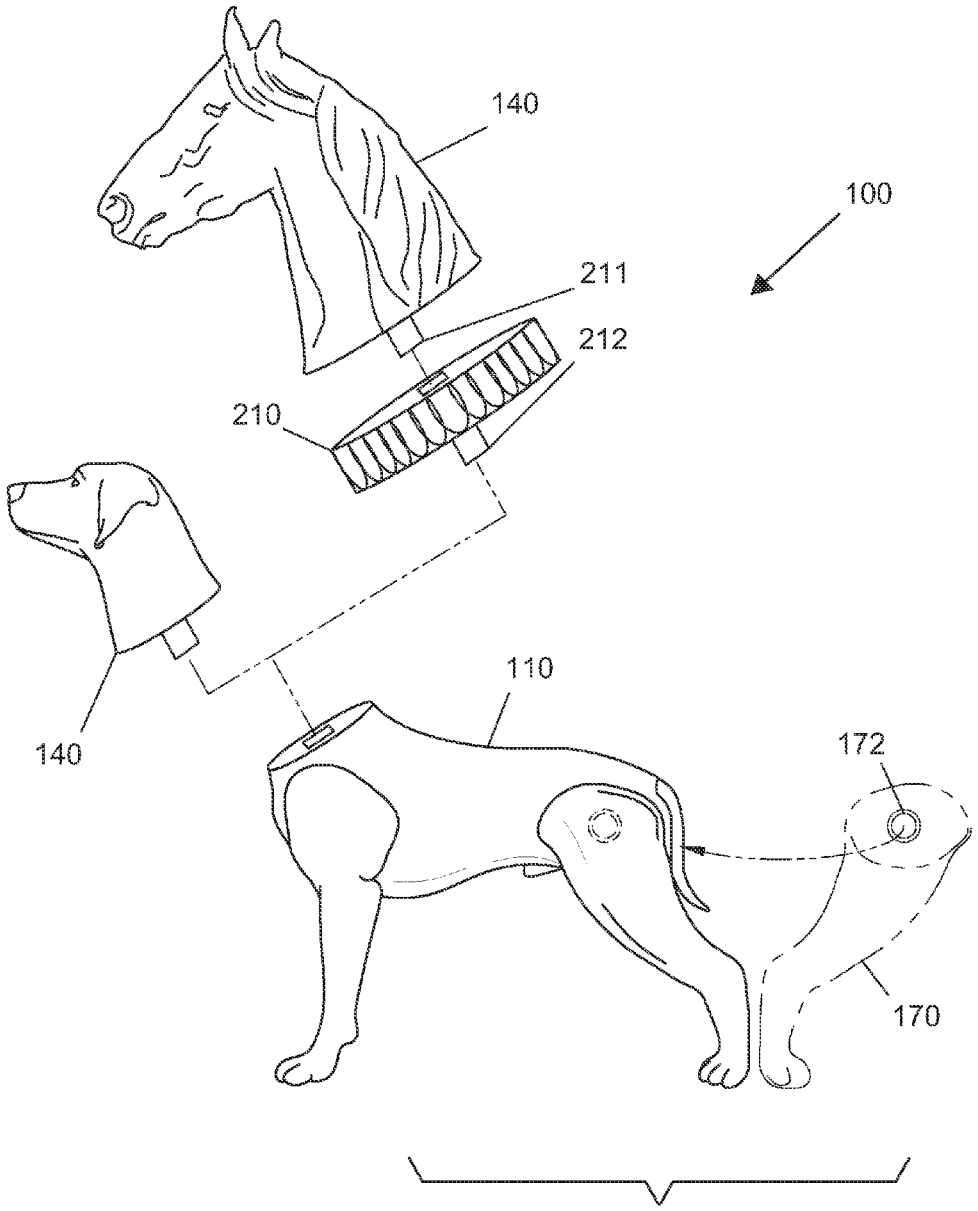
FIG. 4 shows a side view of the present invention featuring interchanging head components.
Figure 5:
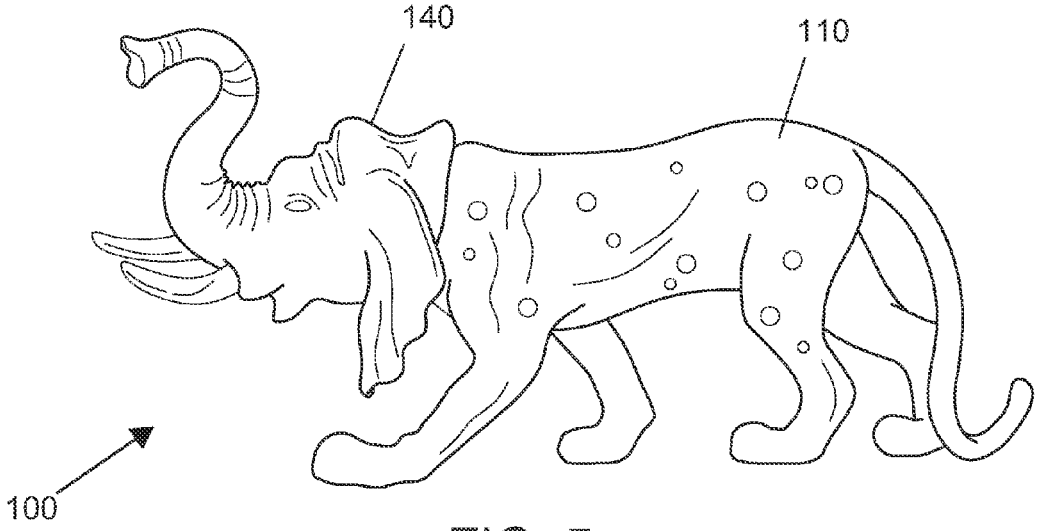
FIG. 5 shows a side view of the present invention featuring interchanging head components.
Figure 6:
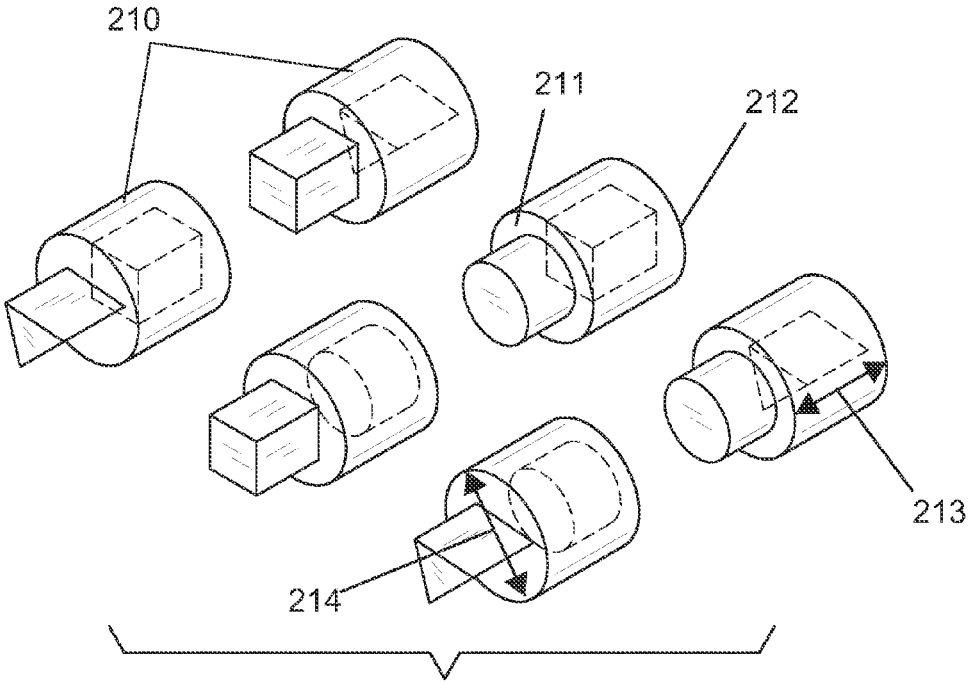
FIG. 6 shows a perspective view of the adapter component of the present invention.

130 Female head component slot
131 Female tail component slot
132 Female first anterior limb component slot
133 Female first posterior limb component slot
134 Female second anterior limb component slot
135 Female second posterior limb component slot
136 Slot
140 Head component
141 Head component posterior end
142 Male head component projection
150 Tail component
151 Tail component anterior end
152 Male tail component projection
160 First anterior limb component
161 First anterior limb component anterior end
162 Male first anterior limb component projection
170 First posterior limb component
171 First posterior limb component anterior end
172 Male first posterior limb component projection
180 Second anterior limb component
181 Second anterior limb component anterior end
182 Male second anterior limb component projection
190 Second posterior limb component
191 Second posterior limb component anterior end
192 Male second posterior limb component projection
200 Projection
210 Adapter component
211 Adapter anterior end
212 Adapter posterior end
213 Offset length
214 Offset diameter Referring now to FIG. 1-6, the present invention features a figurine system (100) having removable and interchangeable appendages. In some embodiments, the system (100) comprises a body component (110) having a body anterior end (111), a body posterior end (112), a body first side (113), and a body second side (114). In some embodiments, the body component (110) comprises a general shape of a body of an animal having a neck area (120), a tail area (121), an anterior leg first side area (122), a posterior leg first side area (123), an anterior leg second side area (124), and a posterior leg second side area (125) corresponding to their respective locations on the body of the animal.

In some embodiments, the body anterior end (111) comprises a female head component slot (130) having a shape of a triangular prism located thereon. In some embodiments, the female head component slot (130) is generally located close to the neck area (120). In some embodiments, the body posterior end (112) comprises a female tail component slot (131) having a shape of a first cylindrical channel located therein. In some embodiments, the female tail component slot (131) is generally located close to the tail area (121).

In some embodiments, the body first side (113) comprises a female first anterior limb component slot (132) having a shape of a rectangular prism located therein. In some embodiments, the female first anterior limb component slot (132) is located close to the body anterior end (111). In some embodiments, the female first anterior limb component slot (132) is generally located close to the anterior leg first side area (122).

In some embodiments, the body first side (113) comprises a female first posterior limb component slot (133) having a shape of a second cylindrical channel located therein. In some embodiments, the female first posterior limb component slot (133) is located close to the body posterior end (112). In some embodiments, the female first posterior limb component slot (133) is generally located close to the posterior leg first side area (123).

In some embodiments, the body second side (114) comprises a female second anterior limb component slot (134) having a shape of the rectangular prism located therein. In some embodiments, the female second anterior limb component slot (134) is located close to the body anterior end (111). In some embodiments, the female second anterior limb component slot (134) is generally located close to the anterior leg second side area (124).

In some embodiments, the body second side (114) comprises a female second posterior limb component slot (135) having a shape of the second cylindrical channel located therein. In some embodiments, the female second posterior limb component slot (135) is located close to the body posterior end (112). In some embodiments, the female second posterior limb component slot (135) is generally located close to the posterior leg second side area (125).

In some embodiments, the female head component slot (130), the female tail component slot (131), the female first anterior limb component slot (132), the female first posterior limb component slot (133), the female second anterior limb component slot (134), and the female second posterior limb component slot (135) are hereinafter collectively referred to as slots (136).

In some embodiments, the system (100) comprises a head component (140) having a head component posterior end (141). In some embodiments, the head component (140) comprises a general shape of a head of the animal. In some embodiments, the head component posterior end (141) comprises a male head component projection (142) having a shape of a triangular prism located thereon. In some embodiments, the male head component projection (142) is designed to snuggly insert into the female head component slot (130).

In some embodiments, the system (100) comprises a tail component (150) having a tail component anterior end (151). In some embodiments, the tail component (150) comprises a general shape of a tail of the animal. In some embodiments, the tail component anterior end (151) comprises a male tail component projection (152) having a shape of a first cylinder located thereon. In some embodiments, the male tail component projection (152) is designed to snuggly insert into the female tail component slot (131).

In some embodiments, the system (100) comprises a first anterior limb component (160) having a first anterior limb component anterior end (161). In some embodiments, the first anterior limb component (160) comprises a general shape of a front limb of the animal. In some embodiments, the first anterior limb component anterior end (161) comprises a male first anterior limb component projection (162) having a shape of a rectangular prism located thereon. In some embodiments, the male first anterior limb component projection (162) is designed to snuggly insert into the female first anterior limb component slot (132).

In some embodiments, the system (100) comprises a first posterior limb component (170) having a first posterior limb component anterior end (171). In some embodiments, the first posterior limb component (170) comprises a general shape of a rear limb of the animal. In some embodiments, the first posterior limb component anterior end (171) comprises a male first posterior limb component projection (172) having a shape of a second cylinder located thereon. In some embodiments, the male first posterior limb component projection (172) is designed to snuggly insert into the female first posterior limb component slot (133).

In some embodiments, the system (100) comprises a second anterior limb component (180) having a second anterior limb component anterior end (181). In some embodiments, the second anterior limb component (180) comprises a general shape of the front limb of the animal. In some embodiments, the second anterior limb component anterior end (181) comprises a male second anterior limb component projection (182) having the shape of the rectangular prism located thereon. In some embodiments, the male second anterior limb component projection (182) is designed to snuggly insert into the female second anterior limb component slot (134).

In some embodiments, the system (100) comprises a second posterior limb component (190) having a second posterior limb component anterior end (191). In some embodiments, the second posterior limb component (190) comprises a general shape of the rear limb of the animal. In some embodiments, the second posterior limb component anterior end (191) comprises a male second posterior limb component projection (192) having the shape of the second cylinder located thereon. In some embodiments, the male second posterior limb component projection (192) is designed to snuggly insert into the female second posterior limb component slot (135).

In some embodiments, the male head component projection (142), the male tail component projection (152), the male first anterior limb component projection (162), the male first posterior limb component projection (172), the male second anterior limb component projection (182), and the male second posterior limb component projection (192) are hereinafter collectively referred to as projections (200).

In some embodiments, the system (100) comprises a plurality of adapter components (210), each having an adapter anterior end (211) and an adapter posterior end (212). In some embodiments, the adapter anterior end (211) comprises a shape selected from a group consisting of the following: the male head component projection (142), the male tail component projection (152), the male first anterior limb component projection (162), the male first posterior limb component projection (172), the male second anterior limb component projection (182), and the male second posterior limb component projection (192). In some embodiments, the adapter posterior end (212) comprises a shape selected from a group consisting of the following: the female head component slot (130), the female tail component slot (131), the female first anterior limb component slot (132), the female first posterior limb component slot (133), the female second anterior limb component slot (134), and the female second posterior limb component slot (135).

In some embodiments, the adapter component (210) comprises an offset length (213) from the adapter anterior end (211) to the adapter posterior end (212). In some embodiments, the adapter component (210) is designed to provide an offset distance from the slot (136) located on the body component (110) to the slot (136) located on the adapter component (210). In some embodiments, the adapter component (210) comprises an offset diameter (214). In some embodiments, the adapter component (210) is designed to provide a transition from the body component (110) to the head component (140), the tail component (150), the first anterior limb component (160), the first posterior limb component (170), the second anterior limb component (180), or the second posterior limb component (190) via the offset diameter (214).

In some embodiments, the body component (110) may resemble a body of any of a variety of animals. In some embodiments, the head component (140), the tail component (150), the first anterior limb component (160), the first posterior limb component (170), the second anterior limb component (180), and the second posterior limb component (190) may resemble the body of any of a variety of animals. In some embodiments, the system (100) is designed for intermixing the body components (110), the head components (140), the tail components (150), the first anterior limb components (160), the first posterior limb components (170), the second anterior limb components (180), and the second posterior limb components (190) of the variety of animals.

In some embodiments, the system (100) comprises an offset length (213) of ½ inch or less. In some embodiments, the system (100) comprises an offset length (213) of 1 inch. In some embodiments, the system (100) comprises an offset length (213) of 2 inches or greater.

As used herein, the term "about" refers to plus or minus 10% of the referenced number.

The disclosures of the following U.S. Patents are incorporated in their entirety by reference herein: U.S. Pat. No. D 576,217; U.S. Pat. No. D 536,044; U.S. Pat. No. D 419,915; U.S. Pat. No. 6,887,120; U.S. Pat. No. 5,897,420; U.S. Pat. No. 4,208,832; U.S. Pat. No. 1,322,713; and U.S. Pat. No. 858,090.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A figurine system (100) having removable and interchangeable appendages, wherein the system (100) comprises:

(a) a plurality of body components (110), each of the body components (110) having a body anterior end (111), a body posterior end (112), a body first side (113), and a body second side (114), wherein each of the body components (110) comprises a general shape of a body of an animal having a neck area (120), a tail area (121), an anterior leg first side area (122), a posterior leg first side area (123), an anterior leg second side area (124), and a posterior leg second side area (125) corresponding to their respective locations on the body of the animal, wherein the body anterior end (111) comprises a female head component slot (130) having a shape of a triangular prism disposed thereon, wherein the female head component slot (130) is generally disposed proximal to the neck area (120), wherein the body posterior end (112) comprises a female tail component slot (131) having a shape of a first cylindrical channel disposed therein, wherein the female tail component slot (131) is generally disposed proximal to the tail area (121), wherein the body first side (113) comprises a female first anterior limb component slot (132) having a shape of a rectangular prism disposed therein, wherein the female first anterior limb component slot (132) is disposed proximal to the body anterior end (111), wherein the female first anterior limb component slot (132) is generally disposed proximal to the anterior leg first side area (122), wherein the body first side (113) comprises a female first posterior limb component slot (133) having a shape of a second cylindrical channel disposed therein, wherein the female first posterior limb component slot (133) is disposed proximal to the body posterior end (112), wherein the female first posterior limb component slot (133) is generally disposed proximal to the posterior leg first side area (123), wherein the body second side (114) comprises a female second anterior limb component slot (134) having a shape of the rectangular prism disposed therein, wherein the female second anterior limb component slot (134) is disposed proximal to the body anterior end (111), wherein the female second anterior limb component slot (134) is generally disposed proximal to the anterior leg second side area (124), wherein the body second side (114) comprises a female second posterior limb component slot (135) having a shape of the second cylindrical channel disposed therein, wherein the female second posterior limb component slot (135) is disposed proximal to the body posterior end (112), wherein the female second posterior limb component slot (135) is generally disposed proximal to the posterior leg second side area (125), wherein the female head component slot (130), the female tail component slot (131), the female first anterior limb component slot (132), the female first posterior limb component slot (133), the female second anterior limb component slot (134), and the female second posterior limb component slot (135) are hereinafter collectively referred to as slots (136);

(b) a plurality of head components (140), each of the head components (140) having a head component posterior end (141), wherein each of the head components (140) comprises a general shape of a head of the animal, wherein the head component posterior end (141) comprises a male head component projection (142) having a shape of the triangular prism disposed thereon, wherein the male head component projection (142) is designed to snugly insert into the female head component slot (130);

(c) a plurality of tail components (150) each having a tail component anterior end (151), wherein each of the tail components (150) comprises a general shape of a tail of the animal, wherein the tail component anterior end (151) comprises a male tail component projection (152) having a shape of a first cylinder disposed thereon, wherein the male tail component projection (152) is designed to snugly insert into the female tail component slot (131);

(d) a plurality of first anterior limb components (160) each having a first anterior limb component anterior end (161), wherein each of the first anterior limb components (160) comprises a general shape of a front limb of the animal, wherein the first anterior limb component anterior end (161) comprises a male first anterior limb component projection (162) having a shape of the rectangular prism disposed thereon, wherein the male first anterior limb component projection (162) is designed to snugly insert into the female first anterior limb component slot (132);

(e) a plurality of first posterior limb components (170) each having a first posterior limb component anterior end (171), wherein each of the first posterior limb components (170) comprises a general shape of a rear limb of the animal, wherein the first posterior limb component anterior end (171) comprises a male first posterior limb component projection (172) having a shape of a second cylinder disposed thereon, wherein the male first posterior limb component projection (172) is designed to snugly insert into the female first posterior limb component slot (133);

(f) a plurality of second anterior limb components (180) each having a second anterior limb component anterior end (181), wherein each of the second anterior limb components (180) comprises a general shape of the front limb of the animal, wherein the second anterior limb component anterior end (181) comprises a male second anterior limb component projection (182) having the shape of the rectangular prism disposed thereon, wherein the male second anterior limb component projection (182) is designed to snugly insert into the female second anterior limb component slot (134);

(g) a plurality of second posterior limb components (190) each having a second posterior limb component anterior end (191), wherein each of the second posterior limb components (190) comprises a general shape of the rear limb of the animal, wherein the second posterior limb component anterior end (191) comprises a male second posterior limb component projection (192) having the shape of the second cylinder disposed thereon, wherein the male second posterior limb component projection (192) is designed to snugly insert into the female second posterior limb component slot (135);

wherein the male head component projection (142), the male tail component projection (152), the male first anterior limb component projection (162), the male first posterior limb component projection (172), the male second anterior limb component projection (182), and the male second posterior limb component projection (192) are hereinafter collectively referred to as projections (200); and (h) a plurality of adapter components (210), each having an adapter anterior end (211) and an adapter posterior end (212), wherein the adapter anterior end (211) comprises a shape selected from a group consisting of the following: the male head component projection (142), the male tail component projection (152), the male first anterior limb component projection (162), the male first posterior limb component projection (172), the male second anterior limb component projection (182), and the male second posterior limb component projection (192), wherein the adapter posterior end (212) comprises a shape selected from a group consisting of the following: the female head component slot (130), the female tail component slot (131), the female first anterior limb component slot (132), the female first posterior limb component slot (133), the female second anterior limb component slot (134), and the female second posterior limb component slot (135), wherein the adapter component (210) comprises an offset length (213) from the adapter anterior end (211) to the adapter posterior end (212), wherein the adapter component (210) is designed to provide an offset distance from the slot (136) disposed on the body component (110) to the slot (136) disposed on the adapter component (210), wherein the adapter component (210) comprises an offset diameter (214), wherein the adapter component (210) is designed to provide a transition from the body component (110) to the head component (140), the tail component (150), the first anterior limb component (160), the first posterior limb component (170), the second anterior limb component (180), or the second posterior limb component (190) via the offset diameter (214);

wherein each of the body components (110) resembles a body of any animal, wherein each of the head components (140), each of the tail components (150), each of the first anterior limb components (160), each of the first posterior limb components (170), each of the second anterior limb components (180), and each of the second posterior limb components (190) resemble body parts of any animal, wherein the system (100) is designed for intermixing the body components (110), the head components (140), the tail components (150), the first anterior limb components (160), the first posterior limb components (170), the second anterior limb components (180), and the second posterior limb components (190) of any animal.

2. The system (100) of claim 1, wherein the offset length (213) is ½ inch or less.

3. The system (100) of claim 1, wherein the offset length (213) is 1 inch.

4. The system (100) of claim 1, wherein the offset length (213) is 2 inches or greater.

* * * * *